US005980351A

United States Patent [19]

McCook

[11] Patent Number: 5,980,351

[45] Date of Patent: Nov. 9, 1999

[54] RECREATIONAL PRINTING DEVICE

[76] Inventor: Norma McCook, 47 Oliver St., Riverhead, N.Y. 11901

[21] Appl. No.: 08/999,447

[22] Filed: Dec. 29, 1997

[51] Int. Cl.[6] ..... A63H 33/00; A63H 13/15; A43C 13/00; A63B 25/00

[52] U.S. Cl. ..... 446/26; 446/146; 36/15; 36/136; 101/327; 482/75

[58] Field of Search ..... 446/26, 27, 28, 446/70, 146, 276, 293, 294; 36/15, 136, 100, 112; 101/327, 333; 482/75, 76, 77, 16

[56] References Cited

U.S. PATENT DOCUMENTS

| | | | |
|---|---|---|---|
| 433,365 | 7/1890 | Pitman | 482/75 |
| 446,540 | 2/1891 | Smith | 101/327 |
| 1,639,381 | 8/1927 | Manelas | 36/15 X |
| 2,075,169 | 3/1937 | Brown | 101/327 |
| 3,538,628 | 11/1970 | Einstein, Jr. | 36/100 X |
| 3,557,782 | 1/1971 | Wafer | 482/75 |
| 4,267,650 | 5/1981 | Bauer | 36/15 X |
| 4,317,294 | 3/1982 | Goodyear | 36/100 |
| 4,924,773 | 5/1990 | Gwilliam | 101/327 |
| 5,228,858 | 7/1993 | Fromm | 101/327 |
| 5,331,753 | 7/1994 | Rodibaugh | 36/136 |
| 5,661,915 | 9/1997 | Smith | 36/15 |

*Primary Examiner*—D Neal Muir
*Attorney, Agent, or Firm*—Alfred M. Walker

[57] ABSTRACT

A set of footwear blocks having a set of footwear blocks has indicia, such as animal tracks or characters thereon, wherein the tracks can be interchanged between different images. The blocks also have rigid handles to support the arms of the child while walking. In a preferred embodiment the height of the rigid handles can be varied so that they can be raised so the child can walk erect while using the blocks underneath the child's shoes, or the height of the handles can be lowered so that the child, while kneeling, can use the blocks as hand-held printing imagines, for imprinting images in soft surface, such as soft ground or sand.

18 Claims, 7 Drawing Sheets

Fig.. 10C

RECREATIONAL PRINTING DEVICE

FIELD OF THE INVENTION

The present invention relates to a recreational printing device for children.

BACKGROUND OF THE INVENTION

Various attempts have been made to provide animal tracks for children. Specifically, U.S. Pat. No. 3,402,485 of McMorrow describes animal track footwear soles wherein animal tracks are molded into a footwear sole for laying simulated tracks of an animal in soft ground.

Furthermore, U.S. Pat. No. 4,050,167 of Senter describes a sneaker sole with three dimensional picture images inscribed in the sole. The sole is designed so that the wearer, such as a child, can leave an imprint in soft ground. In addition, U.S. Pat. No. 4,050,168 of Pace describes a footwear with detachable symbols for placing under the sole so that the printing can be varied.

Other attempts have been made to make a detachable sole with a printed indicia thereon. For example, U.S. Pat. No. 2,754,598 of Aull describes a tracking toy comprising a auxiliary sole member having printed indicia underneath, wherein the auxiliary sole is strapped on by straps around the outside of the shoe.

In addition, U.S. Pat. No. 3,032,897 of Gelineau, while not having indicia imprinted in the sole, describes a sandal member in the shape of a duck track itself, so that the outline of the sandal simulates a duck-webbed foot track.

U.S. Pat. No. 4,697,362 of Wasserman also describes removable indicia for footwear, however, the indicia is placed laterally on the shoe, not underneath the sole for the purposes of imprinting tracks.

Other detachable footwear members include that described in U.S. Pat. No. 2,317,020 of Banister which describes the walking block for children, wherein a platform underneath the shoe is attached by straps over the shoe. Auxiliary soles which are attached by straps to a shoe are also described in U.S. Pat. No. 2,801,478 of Gilbert.

There have also been efforts to enhance a child's recreation by providing stilts, where upon the child's shoe is elevated above another member, such as in U.S. Pat. No. 3,626,609 of Cramer, which is used as a costume device to simulate the lengthening of the child's legs by the stilts underneath the shoe.

Because it is often difficult for the child to be agile while raised above the ground, various patents have been made to provide auxiliary handles to be held while the child's foot or shoe is inserted above or within a member, such as described in U.S. Pat. No. 2,644,248 of Seligman or U.S. Pat. No. 3,479,753 of Wade.

The problem with these two patents of Seligman and Wade is that the handles are attached by leather straps so there is no restriction of motion to stabilize the child's arm from below.

U.S. Pat. No. 5,514,054 of Rowan describes a pair of stilts having a user foot support; U.S. Pat. No. 5,362,288 of Razon describes a device for assisting running, walking or jumping; U.S. Pat. No. 4,268,037 of McKinley describes a training device for developing roping skills and U.S. Pat. No. 4,596,387 of Roberts describes exercise handles for athletic shoes.

Furthermore, because the straps are flexible and not taut, the child cannot hold the handle in the child's hand while kneeling and use the stilt as a hand-held printing device for printing in the sand or soft ground.

OBJECTS OF THE INVENTION

Therefore, an object of the invention to provide an interchangeable footwear toy which can be changed into a hand-held toy for imprinting tracks or other design indicia within sand or soft ground.

It is also an object of the present invention to provide a stilt member which can be converted to a sandal.

It is a further object of the invention to provide a stable handle for supporting the arms of the child while wearing the stilts.

It is another object of the present invention to provide interchangeable indicia for animal tracks and other assorted visual indicia.

It is a further object of the present invention to improve over the disadvantages of the prior art.

SUMMARY OF THE INVENTION

In keeping with these objects and others which may become apparent, the present invention includes a set of footwear blocks having animal track indicia thereon, wherein the tracks can be interchanged between different images. The blocks also have rigid handles to support the arms of the child while walking.

In a preferred embodiment the height of the rigid handles can be varied so that they can be raised so the child can walk erect in a marching motion, while using the blocks underneath the child's shoes, or the height of the handles can be lowered so that the child, while kneeling, can use the blocks as hand-held printing members, for imprinting images in soft ground or sand.

In the preferred embodiment, the images are attached to a removable sole portion, which is either friction fit or detachably attachable to the foot blocks.

DESCRIPTION OF THE DRAWINGS

The present invention can best be described in conjunction with the accompanying drawings, in which.

DETAILED DESCRIPTION OF THE PRESENT INVENTION

Figure 1:
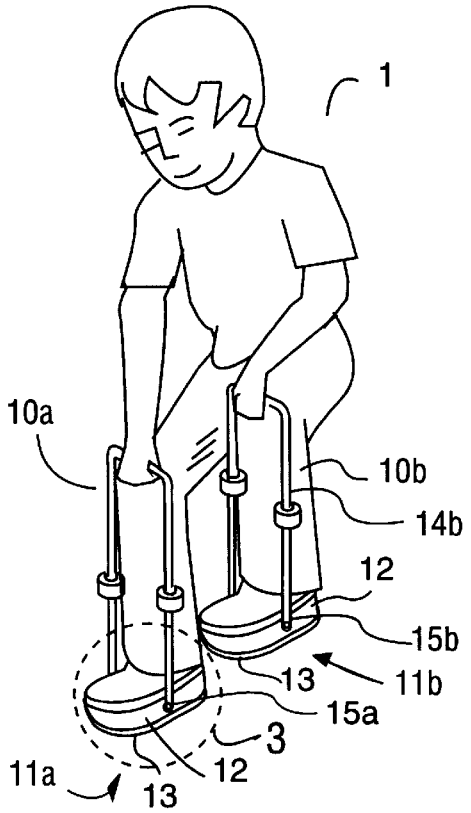
FIG. 1 is a perspective view of one embodiment of the child's printing toy of the present invention.

As shown in FIG. 1, child 1 uses a pair of toys 10*a*, 10*b*, which comprise footwear blocks 11*a*, 11*b*. Footwear blocks 11*a*, 11*b* are generally rounded, rectangular and/or oval shaped, each having sole block 12 and indicia printed pad 13 thereunder. Toys 10*a*, 10*b* further include respective pairs of handles 14*a*, 14*b* which are generally U-shaped, which handles 14*a*, 14*b*, are attached on either side of sole block 12 of respective shoe blocks 11*a*, 11*b*.

Figure 2:
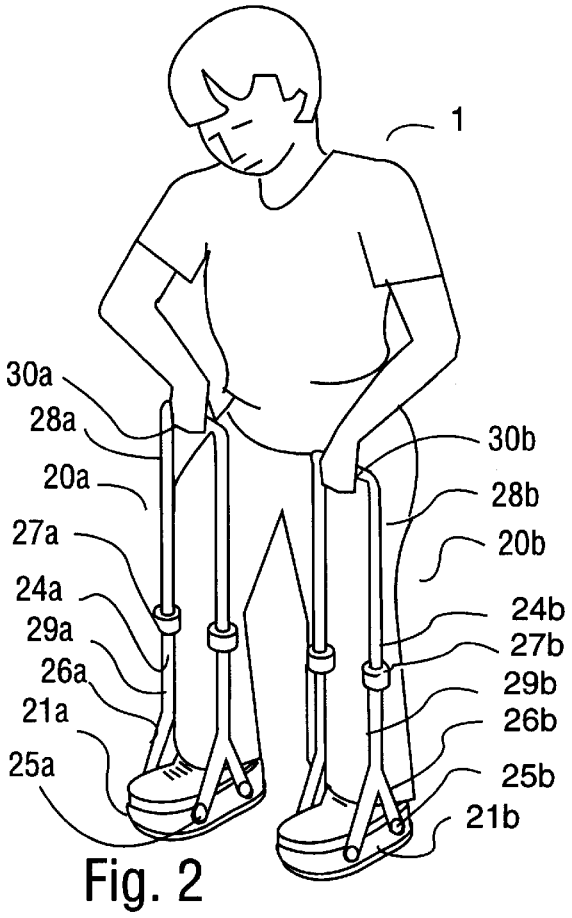
FIG. 2 is a perspective view of another embodiment for the child's printing toy of the present invention.

As shown in FIGS. 1 and 2, sole blocks 12 are preferably several inches high in vertical height.

In the embodiment of FIG. 1, handles 14*a*, 14*b* are rigidly attached at fastening sites 15*a*, 15*b* to each respective sole block 12 of footwear blocks 11*a*, 11*b* respectively, with indicia pads 13 thereunder.

However, in FIG. 2, footwear blocks 21*a*, 21*b* of toys 20*a*, 20*b* include respective sole blocks 12 with indicia pads 13 thereunder, and each footwear block 21*a*, 21*b*, is removable from handles 24*a*, 24*b*. Handles 24*a*, 24*b* are attached to fasteners which can be removed, such as fasteners 25*a*, 25*b*.

In order to prevent rotation of handles 24*a*, 24*b*, each handle 24*a*, 24*b* has, at opposite ends thereof, V-shaped attachment members 26*a*, 26*b* so that handles 24*a*, 24*b* will remain erect. If handles 24*a*, 24*b* were attached at one point, they would tend to shift and rotate. V-shaped attachment members 26*a*, 26*b* keep handles 24*a*, 24*b* erect.

Figure 6:
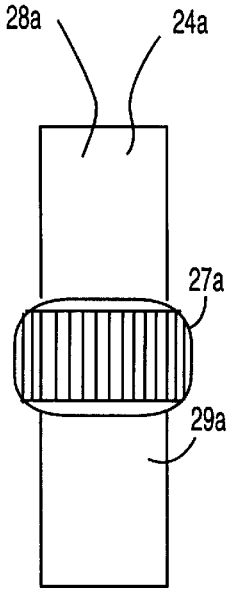
FIG. 6 is an adjustment mechanism for the embodiment shown in FIG. 2.

As noted in FIG. 6, handles 24*a*, 24*b* can be adjusted in size by means of adjustment members 27*a*, 27*b*, as such as is known in the art, which may be twisted in an annular fashion to release upper portion 28*a*, 28*b* from lower portions 29*a*, 29*b* of handles 24*a*, 24*b*.

Furthermore, handles 24*a*, 24*b* each have respective horizontal joining portions 30*a*, 30*b* to enable the child 1 10 to grab handles 24*a*, 24*b* conveniently to steady the gait of the child 1.

Figure 3:
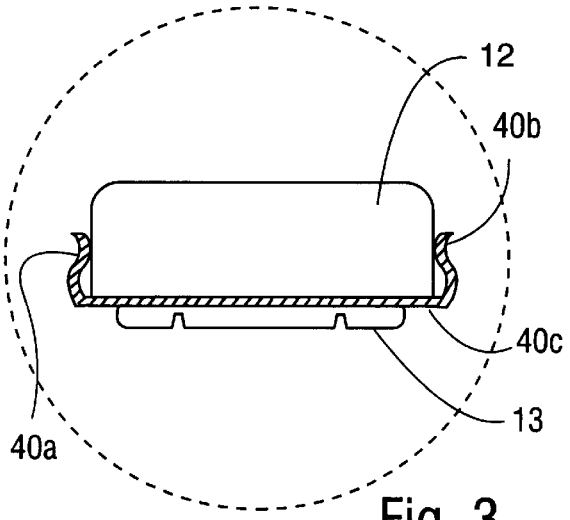
FIG. 3 is a close up front elevational view of one embodiment of the footwear block of the present invention.
Figure 3A:
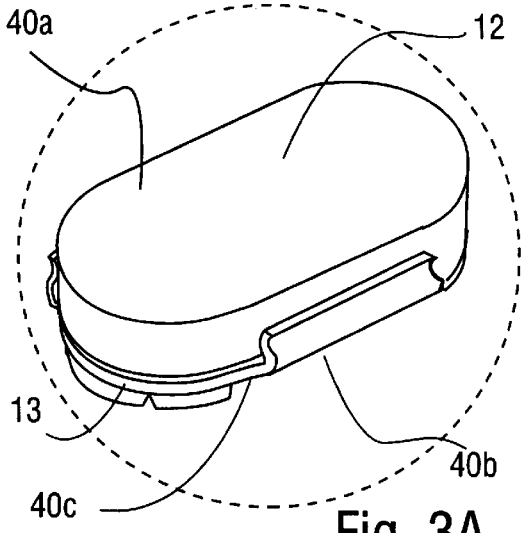
FIG. 3A is an isometric view of the footwear block as in FIG. 3.

As shown in FIGS. 3 and 3A, printed indicia members 13 optionally may be attached to blocks 12 by friction fit, such as by extending leaf springs 40*a*, 40*b*, which are attached to base 40*c*, having indicia pad 13 attached on the underside thereof.

Figure 3B:
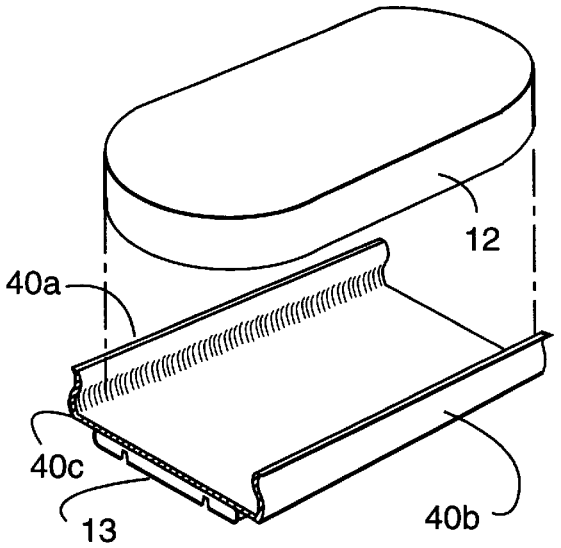
FIG. 3B is an exploded isometric view of the footwear block as in FIG. 3.
Figure 5:
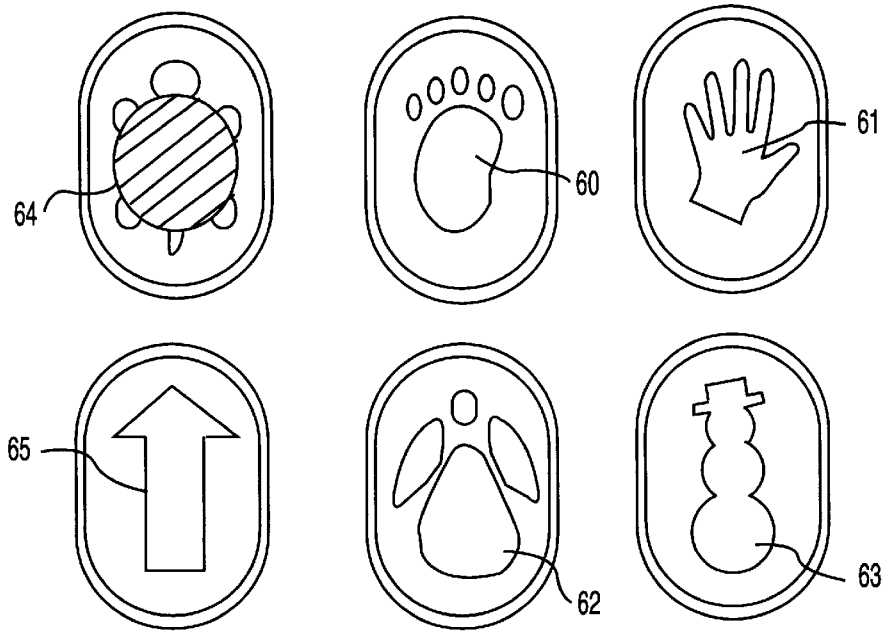
FIG. 5 is a selected views of typical animal tracks or other indicia under the underside of the block of the present invention.

As shown in FIG. 3B, each block 12 can be raised from above base 40*c* so that other alternate indicia pads 13 may be attached, with different images, such as images 60,61, 62,63,64, and 65, shown in FIG. 5 herein.

Figure 3C:
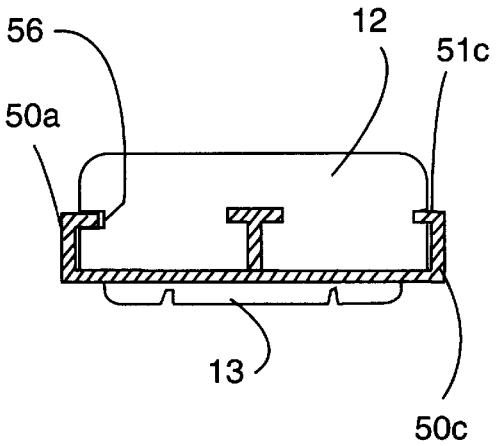
FIG. 3C is a cross sectional view of the footwear block of the present invention.
Figure 3D:
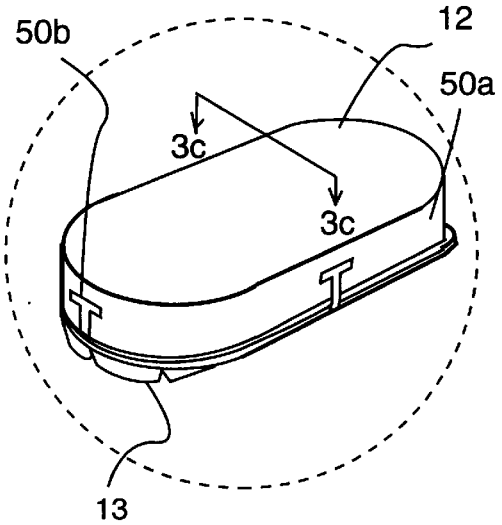
FIG. 3D is an isometric view of the footwear block embodiment as in FIG. 3C.

Other fasteners may be used, such as a plurality of fasteners 50*a*, 50*b*, 50*c*, as shown in FIGS. 3C and 3D, wherein the fastening means which may be snaps or other tongue and groove members 50*a*, 50*b*, 50*c* insertable within recesses 51*a*, 51*b*, 51*c* of block 12.

Figure 3E:
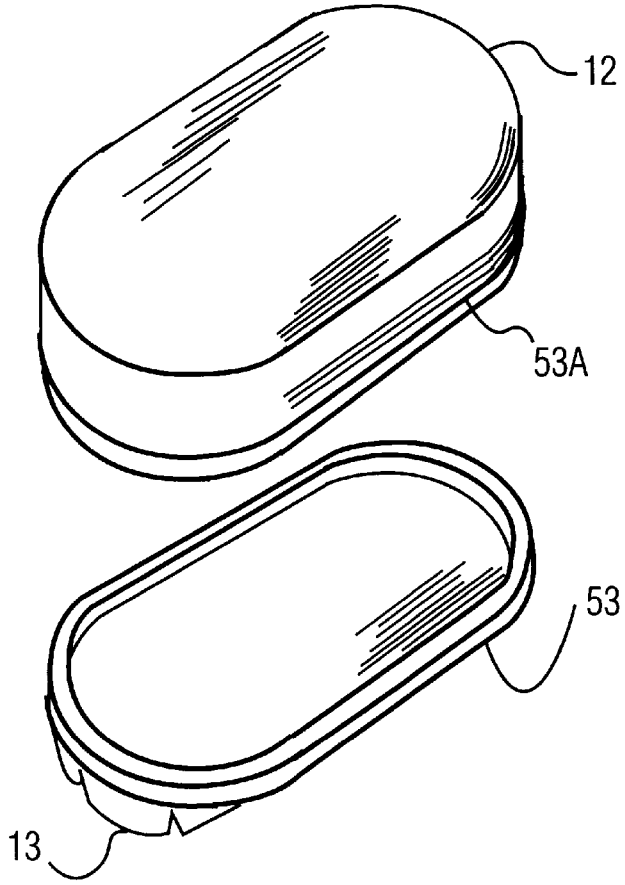
FIG. 3E is an exploded isometric view of an alternate embodiment for a footwear block.
Figure 3F:
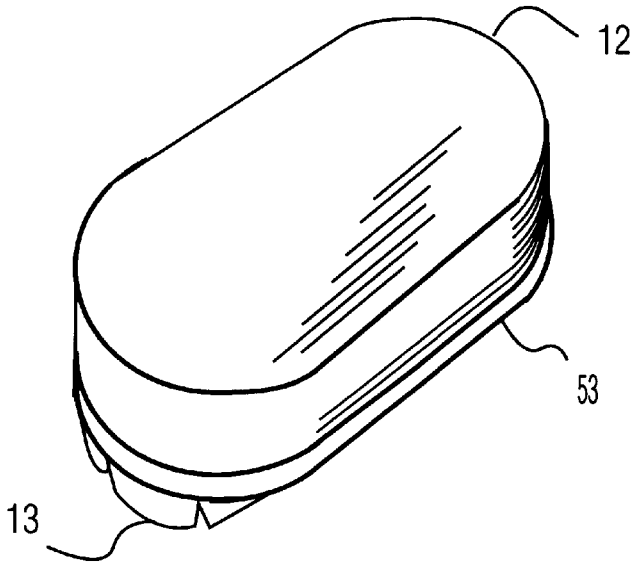
FIG. 3F is an isometric view of the footwear block as in FIG. 3E.

In addition, in an alternate embodiment shown in FIGS. 3E and 3F, fastener 52 for indicia pad 13 is an annular elastomeric pressure fit seal, such as protruding edge member 53, wherein annular edge member 53 is engagable with respective annular grooves 53*a* within block 12, such are used in attaching tops to Rubbermaid® type food containers.

While not shown in the drawings, it is also contemplated that the fastener members may be reversed, wherein an annular protruding member is on sole block 12 instead of indicia pad 13, and wherein an annular groove is within indicia pad 13, instead of sole block 12.

Figure 3G:
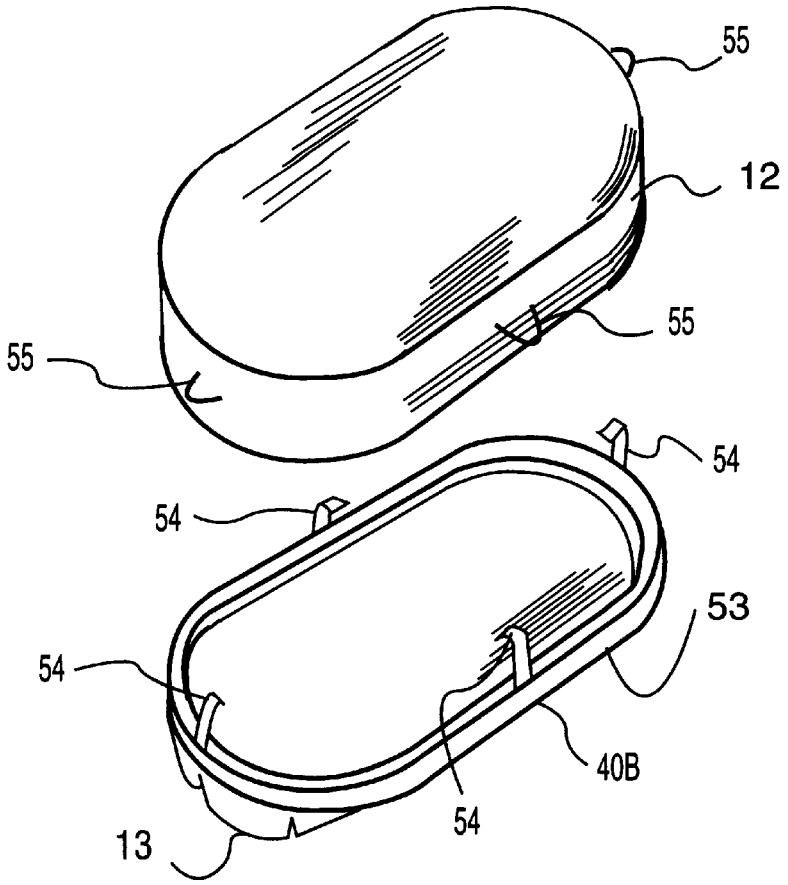
FIG. 3G is an exploded isometric view of a further alternate embodiment for a foot wear block.
Figure 3H:
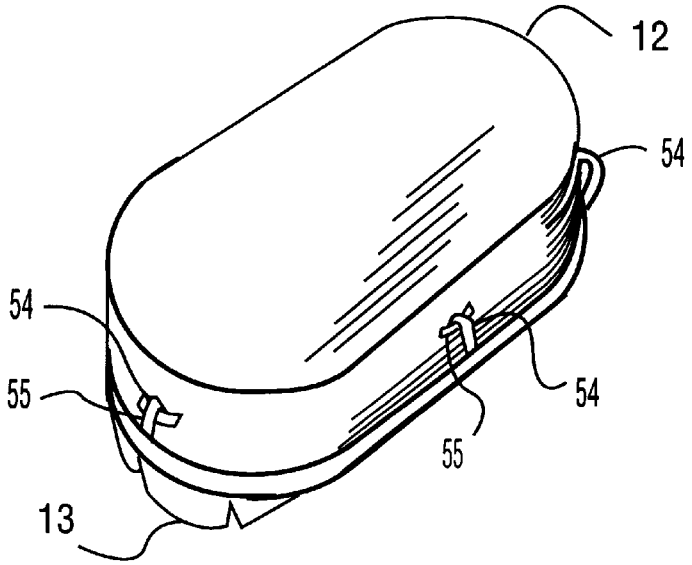
FIG. 3H is an isometric view of the further alternate embodiment as in FIG. 3G.

In a further alternate embodiment as shown in FIG. 3G and 3H, a plurality of fastener pairs 54, 55 are elastomeric pressure fit seals, such as also used in attaching tops to Rubbermaid® type food containers. However, fastener pairs 54, 55 are discontinuous and separate from each other at various points around printing element 13. Fastener pairs 54, 55 include protruding hook-type fasteners 54 which engage over corresponding protruding receptor member 55, extending from sole block 12.

Figure 4:
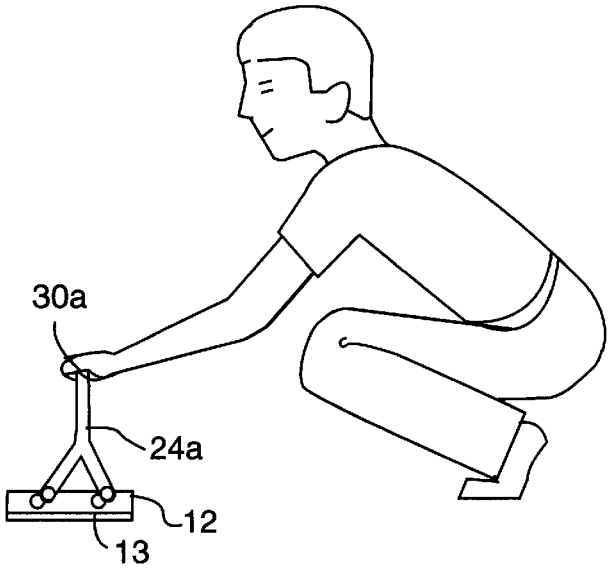
FIG. 4 is a side elevational view showing the printing toy being used as a hand-held toy.

As shown in FIG. 4, each toy 20*a*, 20*b* may be converted from a footwear wearable toy to a hand-held toy, so that the child may reduce the height of handles 24*a*, 24*b* by twisting respective adjustment members 27*a*, 27*b* to lower upper portions 28*a*, 28*b* into hollow interiors of lower portions 29*a*, 29*b* of handles 24*a*, 24*b*. As shown in FIG. 4, the child 1 can then kneel down at the beach and use his or her hands by virtue of manually pressing on joint portion 30*a* of a pair of handles 24*a*, 24*b*, to push sole block 12 with indicia pad 13 thereunder into a soft ground surface.

As noted, FIG. 5 shows a plurality of various printed images, such as animal track 60, hand 61, characters 62, 63, wildlife 64 or general directional indicia 65, which are imprinted on various interchangable indicia pads 13, so that the child 1 can select whatever image the child 1 wants to use.

FIG. 6 shows a typical twisting tightening device 27*a* joining members 28*a*, 29*a* of handle 24*a* for raising or lowering the height thereof.

Figure 7:
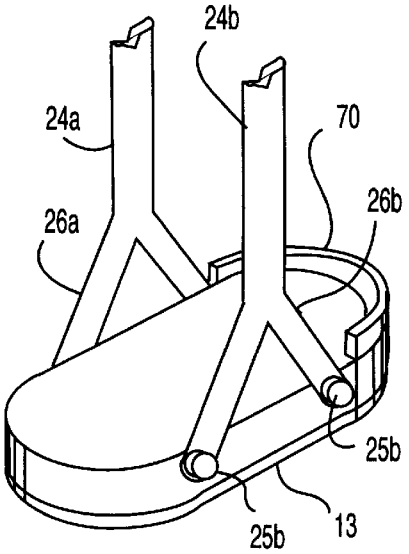
FIG. 7 is a close up perspective view of the foot/sole portion of the embodiment shown in FIG. 2.

FIG. 7 shows a close up view of the attachment of sole block 12 with an alternate heel retaining member 70 attached thereto.

Figure 8:
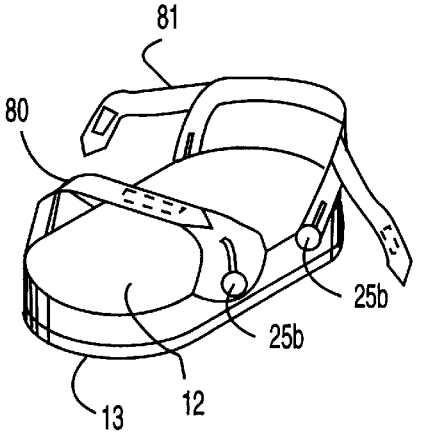
FIG. 8 is an isometric view of the footwear block of the present invention used as a sandal.

In FIG. 8, sole block 12 may be converted to a sandal by removing handles 24*a*, 24*b* from fastening members 25*a*, 25*b* and inserting thereon straps 80, 81, so that sole block 12 and indicia pad 13 can be worn interchangeably as a sandal with the tracking members underneath.

Figure 9:
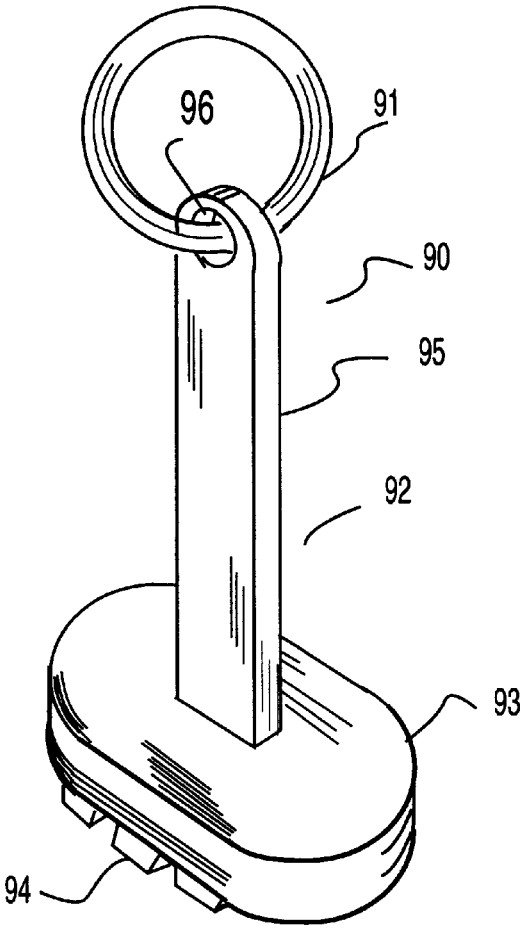
FIG. 9 is an isometric view of a further embodiment for a hand held recreational printing device.
Figure 9B:
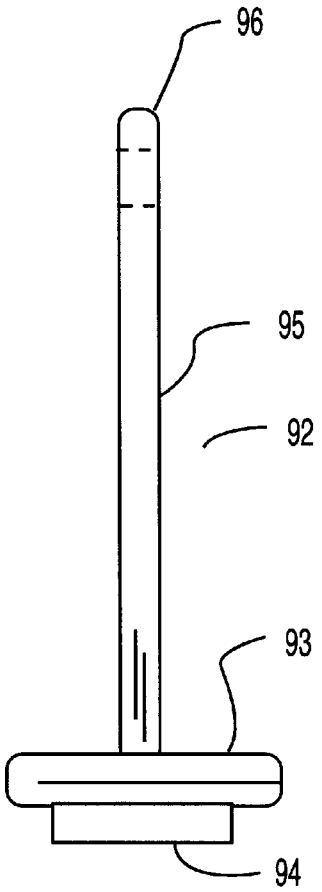
FIG. 9B is a side elevational view of the printing portion of the device as in FIG. 9.
Figure 9A:
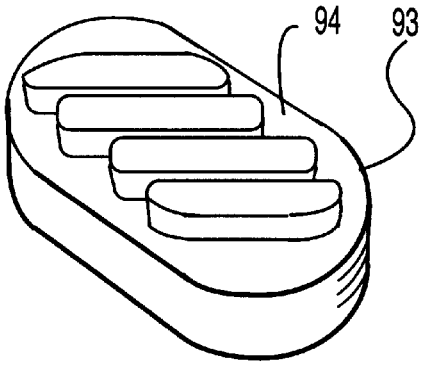
FIG. 9A is a bottom view of the recreational printing device; as in FIG. 9.

As shown in FIGS. 9, 9A and 9B in a further hand held embodiment for recreational printing device 90, there is provided hand held key chain type ring 91 for attachment thereto at least one printing member 92. Printing member 92 includes base 93 with raised indicia 94. Printing member 92 is connected by handle 95 at loop portion 96 to handle ring 91. While FIG. 9 shows one printing element 90, it is contemplated that a plurality of printing elements 90 can also be provided on handle ring 91. Therefore, a child user can carry one or more printing elements 90 on handle ring 91 for use in soft ground or sand.

Figure 10:
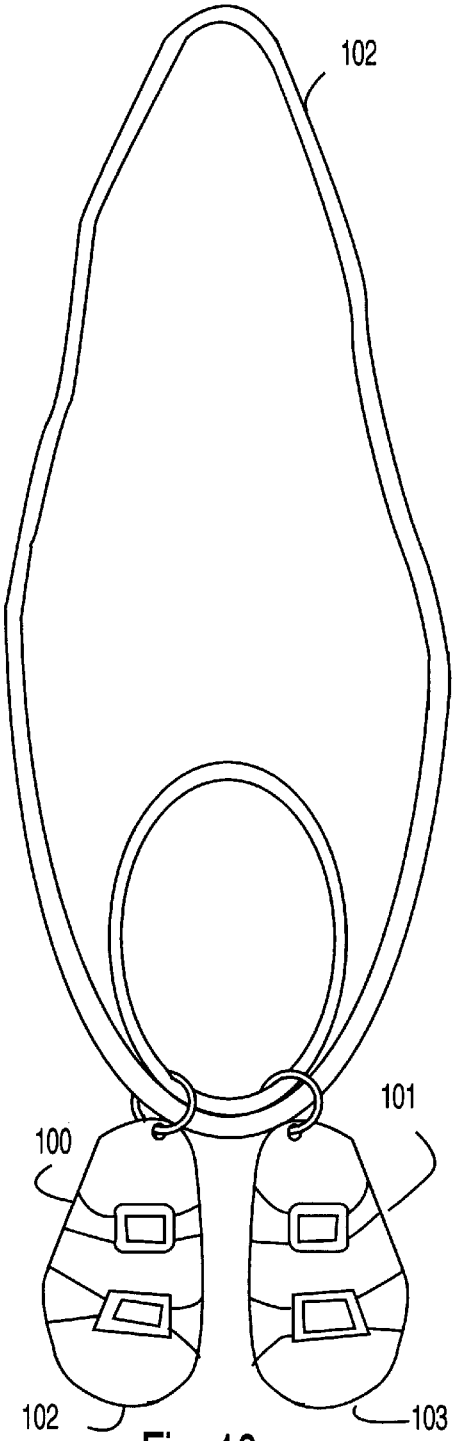
FIG. 10 is an isometric view of a wearable embodiment with miniature printing elements.
Figure 10D:
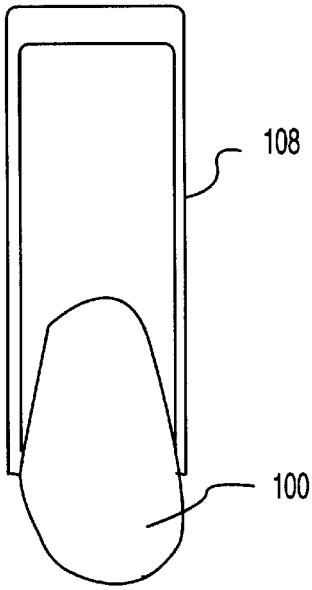
FIGS. 10A, 10B show printing indicia used with the embodiment as shown in FIG. 10.
FIG. 10C is a top plan view of the miniature printing elements of FIG. 10, and, FIG. 10D is an isometric view of another hand held miniature embodiment.
Figure 10A:
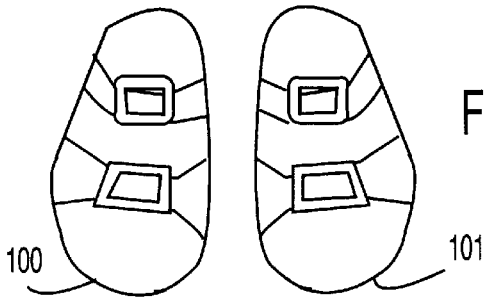
Figure 10A:
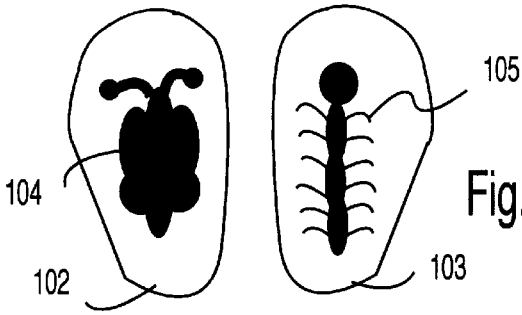
Figure 10B:
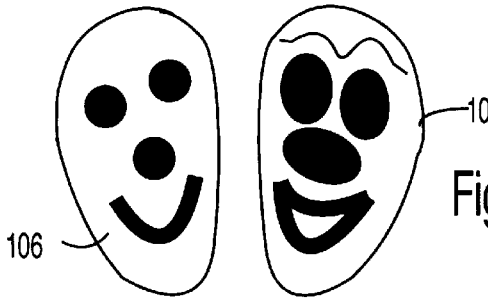

As shown in FIGS. 10, 10A, 10B, 10C, and 10D, a further hand held embodiment includes miniature printing elements 100, 101 held together on wearable ring 102, such as a necklace or wrist bracelet. Miniature printing elements 100, 101 have respective bases 102, 103 with raised indicia 104, 105 or 106, 107 thereon. Alternatively, as shown in FIG. 10D, printing elements 100 may be attached to handle 108, such as a U-shaped handle.

It is noted that other modifications may be made to the present invention without departing from the scope of the invention as noted in the appended claims.

I claim:

1. A set of footwear blocks having printing indicia thereon, said printing indicia being imprintable upon soft surfaces, said set of footwear blocks comprising:

at least one vertically extending sole block portion accommodating a foot thereon, said sole block portion having attachable thereto at least one removable indicia printing member thereunder, said removable indicia printing member including an attachment means for removably attaching said indicia printing member to an underside of said at least one sole block portion, wherein said at least, one sole block portion includes a continuous weight bearing generally U-shaped rigid handle extending upward therefrom and rigidly connected to opposing sides of said sole block portion to support the arms of a user while walking with the user's foot being supported thereon.

2. The set of footwear blocks as in claim 1 wherein said at least one indicia printing member comprises a plurality of interchangeable indicia printing members, each said indicia printing member having a separate printing indicia thereon, wherein said interchangeable indicia printing members can be interchanged between different images.

3. The set of footwear blocks as in claim 1 further comprising a means to adjust the height of said rigid handle, wherein said rigid handle can be raised so the user can walk erect while wearing said at least one sole block underneath the user's foot, and wherein the height of said rigid handle can be lowered so that the user, while kneeling, can manipulate said at least one sole block as a hand-held printing member, for imprinting images in the soft surface.

4. The set of footwear blocks as in claim 1 wherein said attachment means of said indicia printing member comprises a friction fit member removably attachable to said sole block.

5. The set of footwear blocks as in claim 1 wherein said rigid handle of said sole block is generally U-shaped.

6. The set of footwear blocks as in claim 1 wherein said rigid handle is removably attachable from said at least one sole block.

7. The set of footwear blocks as in claim 6 wherein said rigid handle is attachable to said sole block by at least one removable fastener.

8. The set of footwear blocks as in claim 7 wherein said rigid handle includes a means to prevent rotation of said rigid handles about said sole block.

9. The set of footwear blocks as in claim 8 wherein said means to prevent rotation of said rigid handle about said sole block comprises a V-shaped attachment member at a base of rigid handle, said V-shaped attachment member holding said rigid handle erect.

10. The set of footwear blocks as in claim 5 wherein said U-shaped rigid handle includes a horizontal joining portion to enable the user to grab said rigid handle conveniently to steady the gait of the user.

11. The set of footwear blocks as in claim 4 wherein said friction fit member includes an extendable leaf spring removably attachable to said sole block.

12. The set of footwear blocks as in claim 1 wherein said attachment means of said indicia printing member is at least one protruding fastener engagable with at least one receptor member.

13. The set of footwear blocks as in claim 1 wherein said attachment member of said indicia printing member is at least one elastomeric pressure fit seal attached to said sole block, said elastomeric pressure fit seal comprising an annular protruding edge member engagable with a respective annular groove member.

14. The set of footwear blocks as in claim 1 wherein said at least indicia printing member includes a printed animal track image.

15. The set of footwear blocks as in claim 1 wherein said indicia printing member includes a recognizable character image.

16. The set of footwear blocks as in claim 1 wherein said sole block includes a heel retaining member.

17. The set of footwear blocks as in claim 1 wherein said sole block is convertible to a footwear sandal by removing said rigid handle from said sole block and replacing said rigid handle with a set of foot accommodating straps thereto, so that a foot of the user can be worn interchangeably as a sandal with said indicia printing member thereunder.

18. A set of footwear blocks having printing indicia thereon, said printing indicia being imprintable upon soft surfaces, said set of footwear blocks comprising:

at least one vertically extending sole block portion accommodating a foot thereon, said sole block portion having attachable thereto at least one removable indicia printing member thereunder, said removable indicia Printing member including an attachment means for removably attaching said indicia printing member to an underside of said at least one sole block portion, wherein said at least one sole block portion includes a rigid handle extending upward therefrom to support the arms of a user while walking with the user's foot being supported thereon, and, a means to adjust the height of said rigid handle, wherein said rigid handle can be raised so the user can walk erect while wearing said at least one sole block underneath the user's foot, and wherein the height of said rigid handle can be lowered so that the user, while kneeling, can manipulate said at least one sole block as a hand-held printing member, for imprinting images in the soft surface, wherein said means to adjust the size of said rigid handle comprises a twist lock which is twistable in an annular fashion to release an upper portion of said rigid handle into a hollow interior of a lower portion of said rigid handle.

* * * * *